United States Patent [19]

Harris

[11] 4,198,590

[45] Apr. 15, 1980

[54] HIGH CURRENT TRIGGERED SPARK GAP

[75] Inventor: Neville W. Harris, Acton, Mass.

[73] Assignee: High Voltage Engineering Corporation, Burlington, Mass.

[21] Appl. No.: 961,403

[22] Filed: Nov. 16, 1978

[51] Int. Cl.[2] ..... H01J 17/30

[52] U.S. Cl. ..... 315/335; 313/197; 313/198; 313/217; 313/306

[58] Field of Search ..... 315/335, 337; 313/192, 313/197, 198, 217, 306; 361/120

[56] References Cited

U.S. PATENT DOCUMENTS

| | | | |
|---|---|---|---|
| 3,030,547 | 4/1962 | Dike et al. | 313/197 X |
| 3,229,146 | 1/1966 | Linkroum | 313/197 X |
| 4,015,172 | 3/1977 | Peche et al. | 313/217 X |
| 4,027,187 | 5/1977 | Rabe | 313/217 |

*Primary Examiner*—Eugene R. LaRoche
*Attorney, Agent, or Firm*—Russell & Nields

[57] ABSTRACT

A triggered spark gap suitable for use with high levels of voltage and current over long periods of time generally comprising support means, a pair of insulated main electrodes disposed opposite each other on the support means so as to form a gap therebetween, first electrical means associated with the main electrodes for creating a potential difference therebetween, at least one trigger electrode defining a region having a cross-sectional thickness to width ratio greater than one, said trigger electrodes being mounted on the support means such that said region is disposed in the gap between the main electrodes, and second electrical means connecting the trigger electrode to a source of triggering and biasing potential.

5 Claims, 13 Drawing Figures

HIGH CURRENT TRIGGERED SPARK GAP

BACKGROUND OF THE INVENTION

1. Field of the Invention

This invention generally pertains to spark gaps and more particularly relates to triggered spark gaps wherein the trigger electrode, or a substantial portion of it, is disposed in the region between the main electrodes.

2. Description of Prior Art

Triggered spark gaps were devised to make insulating gaps in electrical circuits, normally high voltage circuits, electrically conductive. Additionally, triggered spark gaps have been found to switch from the nonconducting state to the conducting state extremely rapidly and with a timing accuracy, or jitter, of a few nanoseconds. As a result of this and other features triggered spark gaps have found substantial acceptance and circuits such as the Marx generator have been developed which take advantage of the unique characteristics of these devices.

Generally speaking, the two sides of a gap in an electrical circuit are connected to opposite electrodes of the spark gap. The spark gap thus formed may then be closed by applying a high voltage pulse, or step, to a third electrode known as the trigger electrode. This trigger electrode may lie partly inside one main electrode, or alternatively, may be disposed between the main electrodes. Spark gaps of this construction may be triggered and closed with delays of 10 nanoseconds and with an accuracy, or jitter, of less than 1 nanosecond.

Before switching, the voltage of the trigger electrode is held at a potential between the voltages of the main electrodes. The spark gap may then be switched by applying a voltage pulse, or step, to the trigger electrode. When this is done, the voltage difference between the trigger electrode and first of the main electrodes is decreased whilst the voltage difference between the trigger electrode and the second of the main electrodes is increased. If this latter voltage difference is sufficiently large, the gap between the trigger electrode and the second main electrode will be crossed by an arc quickly bringing the voltage on the trigger electrode to that of the second main electrode. At this point the voltage difference that was originally applied between the main electrodes is applied between the trigger electrode and the first main electrode. If this voltage is sufficiently large, this gap is closed by an arc thus completing the switching action. The breakdown of these two gaps, that is between the trigger electrode and each of the two main electrodes, is partly due to the increased average electric field and partly due to the distortion of the electric field caused by the change of voltage of the trigger electrode. This switching action is usually helped by the presence of sharp edges on the trigger electrode which cause a localized enhancement of the electric field above the strength of the switching medium in their immediate vicinity. The localized field enhancement so caused acts additively with the change of voltage of the trigger electrode during the application of the voltage pulse thereto to produce a field distortion of greater magnitude than the voltage change alone could produce and thereby facilitates accurate switching.

In conventional triggered spark gaps, the cross sectional dimension of the trigger electrode extending through the gap parallel to the direction of current flow, hereinafter thickness, is less than or equal to the cross sectional dimension perpendicular thereto, hereinafter width, in order to minimize the field distortion caused by the trigger electrode and to maximize the strength of the gap. The action of the arcs, however, causes erosion of the trigger electrode primarily at the corners where the electric field, and thus arcing, is maximum. This blunting of the corners in turn reduces the maximum electric field and hence the triggering ability of the trigger electrode. The magnitude of this erosion effect is directly related to the level of current passed by the gap, the higher the current passed the worse the erosion. For this reason, some workers in the art have used pre-blunted and/or rounded trigger electrodes so that erosion effects will cause smaller alterations in performance over the life of the gap. This solution to the erosion problem while beneficial in certain particular instances entails a significant sacrifice in usuable triggering range throughout the life of the switch and is consequently of restricted application.

The switching medium used in a triggered spark gap can be a liquid, a gas or a mixture of gases. Conventional spark gap switches generally include a housing, or container, whereby the switching medium is retained, and such housings may also serve as a frame to maintain the relative positions of the electrodes. In the event that air is to serve as the switching medium, however, no container or housing is required, but a frame to maintain relative electrode positions is required. Similarly, a frame, on which the electrodes are mounted, is required where one or more gaps are part of a device which is hermitically sealed in a container.

SUMMARY OF THE INVENTION

The present invention provides a triggered spark gap suitable for substantially consistant performance over long periods at high levels of voltage and current. Specifically, the present invention provides a trigger electrode geometry which in return for minor increases in field distortion and decreases in gap strength allows the switching range of the gap to remain satisfactory in the face of all but gross erosion of the trigger electrode. More specifically, the present invention generally contemplates a triggered spark gap having support means, a pair of insulated main electrodes disposed opposite each other on the support means so as to form a gap therebetween, first electrical means associated with the main electrodes for creating a potential difference therebetween, at least one trigger electrode defining a region having a cross-sectional thickness to width ratio greater than one, said trigger electrodes being mounted on the support means such that said region is disposed in the gap between the main electrodes, and second electrical means connecting the trigger electrode to a source of triggering and biasing potential.

It is thus an object of the present invention to provide a triggered spark gap capable of consistant operation at high levels of voltage and current for long periods of time.

It is also an object of the present invention to provide a triggered spark gap wherein the switching range of the gap remains satisfactory in the face of all but gross levels of erosion of the trigger electrode.

It is further an object of the present invention to provide a triggered spark gap operable over broad ranges of voltage and capable of passing wide ranges of current so as to be of general rather than specialized application.

BRIEF DESCRIPTION OF THE DRAWINGS

These, as well as other features, objects, and advantages of the present invention, will be more clearly understood by reference to the following detailed description of a preferred embodiment of the present invention and to the drawings in which:

FIG. 1(*a*) is a cross-sectional view of the triggered spark gap taken along the line 1(*a*)—1(*a*) of FIG. 1;

FIG. 2(*b*) is an electrical potential analysis of the conventional triggered spark gap of FIG. 2 after one gap has closed;

FIG. 3(*b*) is an electrical potential analysis of the conventional triggered spark gap of FIG. 3 after one gap has closed;

FIG. 4(*b*) is an electrical potential analysis of the triggered spark gap of FIG. 4 after one gap has closed;

FIG. 8(*b*) diagramatically shows a third alternative electrode configuration suitable for use with the present invention including two main electrodes and two trigger electrodes.

DESCRIPTION OF THE PREFERRED EMBODIMENT

Figure 1:
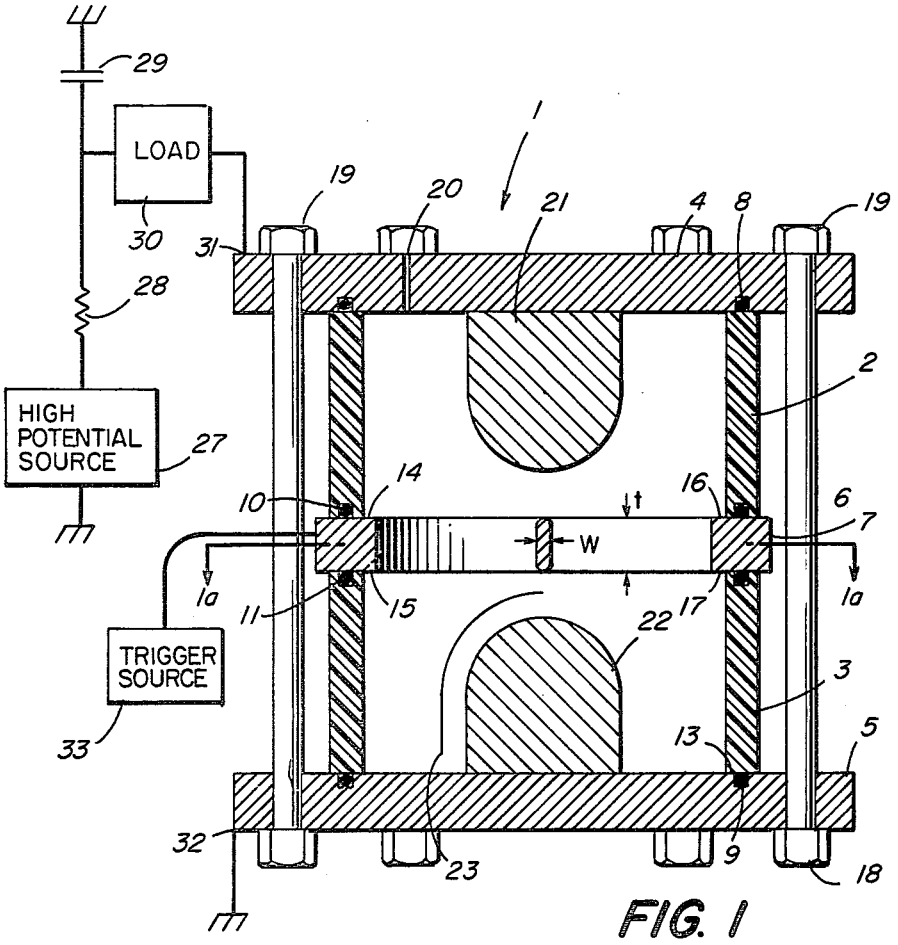
FIG. 1 is a cross-sectional view of a triggered spark gap in accordance with the present invention including block representations of circuitry to be associated therewith.
Figure 1A:
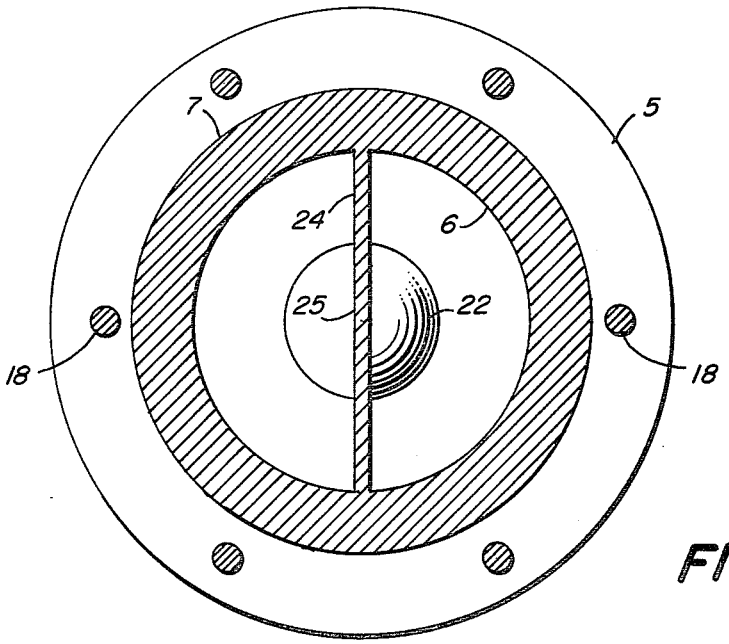

Referring now specifically to the drawing FIG. 1 shows, in section, a triggered spark gap in accordance with the present invention. The housing, generally indicated at 1, consists of tubular insulators 2 and 3 respectively separating metallic flanges 4 and 5 from tubular portion 6 of trigger electrode 7. The housing 1 is also contemplated to be hermetically sealed. This sealing may be accomplished by placing flexible gaskets 8, 9, 10, and 11 respectively between flange 4 and end 12 of insulator 2, flange 5 and end 13 of insulator 3, side 14 of tubular portion 6 of trigger electrode 7 and end 16 of insulator 2, and side 15 of tubular portion 6 and end 17 of insulator 3, and clamping the housing together by insulating bolts and nuts, 18 and 19 respectively, as shown in FIG. 1. Alternatively, sealing may be accomplished by gluing or brazing each joint in which case clamping would not be necessary. It is specifically contemplated that the housing 1 will have means, such as drilled path 20 in flange 4 for the control of the pressure and composition of the atmosphere within the housing. It should also be noted at this point that the shape of the housing 1 is not critical to the correct switching operation of the triggered spark gap, the only important consideration being that electrical breakdown should not occur along the housing. Fixed or main electrodes 21 and 22 are secured opposite each other within the housing 1 to flanges 4 and 5 respectively thereby forming gap 23 therebetween. These main electrodes may be hemispherical, cylindrical, curved in one or two planes, or of special profile, for example a Rogowski or a Bruce profile, depending upon the electric field characteristics desired within the housing. Trigger electrode 7, most clearly seen in FIG. 1(*a*), on the other hand, consists of tubular portion 6 and straight portion 24 extending along a diameter of the cross section of tubular portion 6 such that the arc receiving region 25 of straight portion 24 is located in the gap 23 between main electrodes 21 and 22. The arc receiving region 25 may of any cross sectional geometric shape desired so long as its thickness, dimension t of FIG. 1, to width, dimension w of FIG. 1, ratio is greater than one.

The electrodes 21 and 22 may be of brass or any good electrical conductor. The insulators 2 and 3 may be of glass where it is desired to seal directly to the flanges 4 and 5 and trigger electrode 7 or may alternatively be made of plastic where assembly by bolting is preferred. The trigger electrode 7 may also be made of brass and is preferably constructed of a material which is a good thermal and electrical conductor. Both trigger electrode, and main electrodes also should be fabricated from a material that resists erosion due to switching.

FIG. 1 also includes an exemplary representation of circuitry suitable for use with the present invention. Thus, high potential source 27, is connected via a resistor 28, to a capacitor 29 and one terminal of a load 30; and the other terminal of the load 30 is connected to a terminal 31 of flange 4. A similar terminal 32 of flange 5 is connected to ground, as is one terminal of capacitor 29 and one terminal of the high potential source 27. Trigger electrode 7 is connected independantly to trigger source 33. This circuitry will be recognized as a conventional method of supplying short pulses of very high power to a load.

Figure 2A:
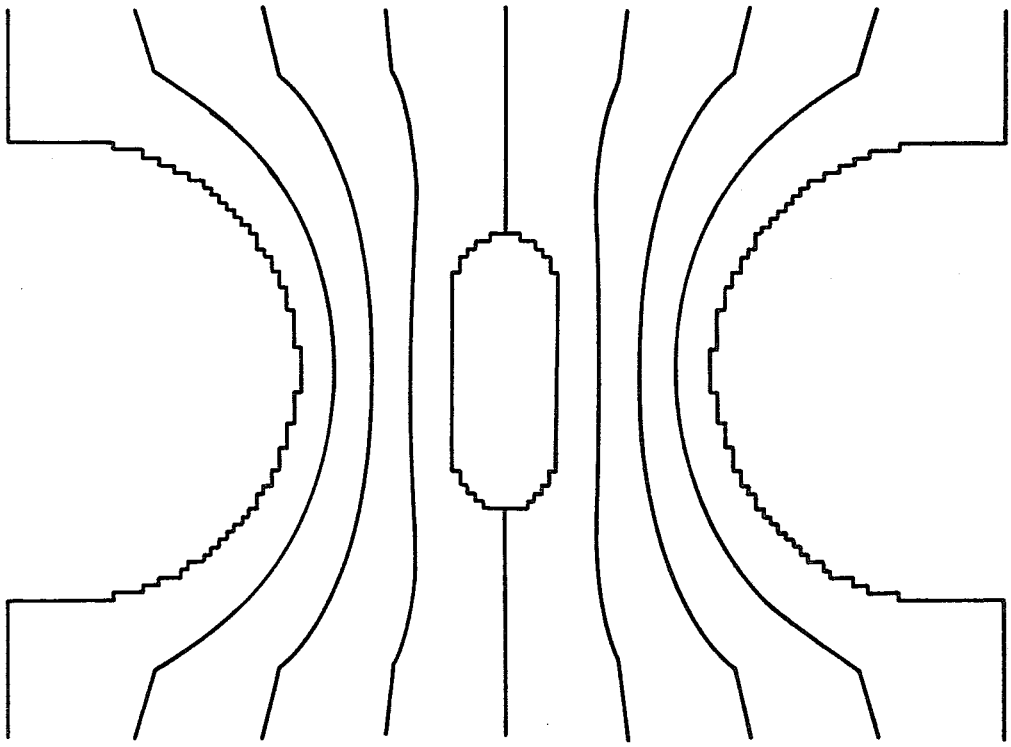
PRIOR ART FIG. 2A
FIG. 2(*a*) is an electrical potential analysis of a conventional triggered spark gap with a flat trigger electrode prior to switching.
Figure 2B:
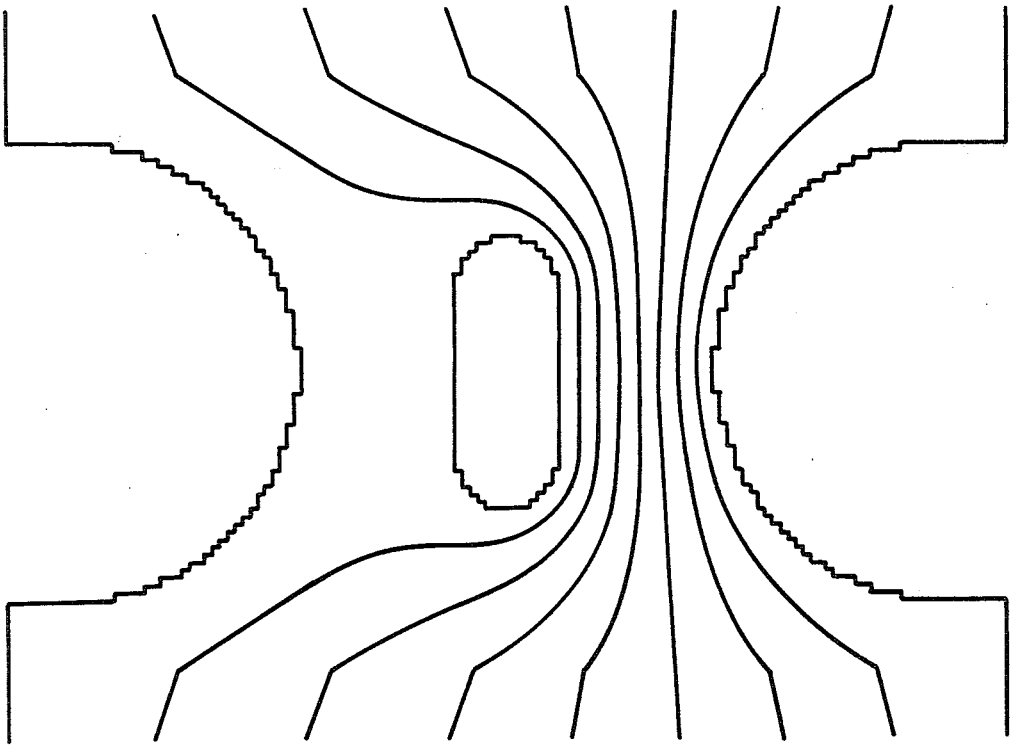
PRIOR ART FIG. 2B

The action of the trigger electrode is illustrated in FIGS. 2(*a*), 2(*b*), 3(*a*), 3(*b*), 4(*a*), and 4(*b*). These figures show the three electrodes and the resulting equipotentials at 12½% intervals. The electric field is inversely proportional to the distance between equipotentials, and thus the regions of maximum electric field are those regions with the most closely packed equipotentials. The trigger electrode is shown exactly halfway between the two main electrodes and the trigger electrode voltage, or potential, before switching is shown as exactly midway between the voltages of the main electrodes. This is illustrative only, the trigger electrode may lie anywhere between the main electrodes in which case its voltage before switching would be suitably adjusted.

In FIG. 2(*a*), we show the plot of equipotentials before switching, in a conventional triggered spark gap having a flat trigger electrode and in FIG. 2(*b*) the equipotentials present in the device of FIG. 2(*a*) after one gap has closed. Inspection of FIG. 2(*b*) shows that the region of maximum electric field occurs at the center of one of the main electrodes. Thus, this design is relatively insensitive to erosion as there is a large area available for arc sites. There is, however, little enhancement of the electric field caused by the trigger electrode shape and switching range is consequently small. An alternative version of FIG. 2(*a*) would employ a rectangular bar for the trigger electrode. The corners of such a bar are sharp and hence considerable electric field enhancement occurs at these corners. This alternative version would thus have an improved switching range but at the same time would be very sensitive to arc erosion of the corners.

Figure 3A:
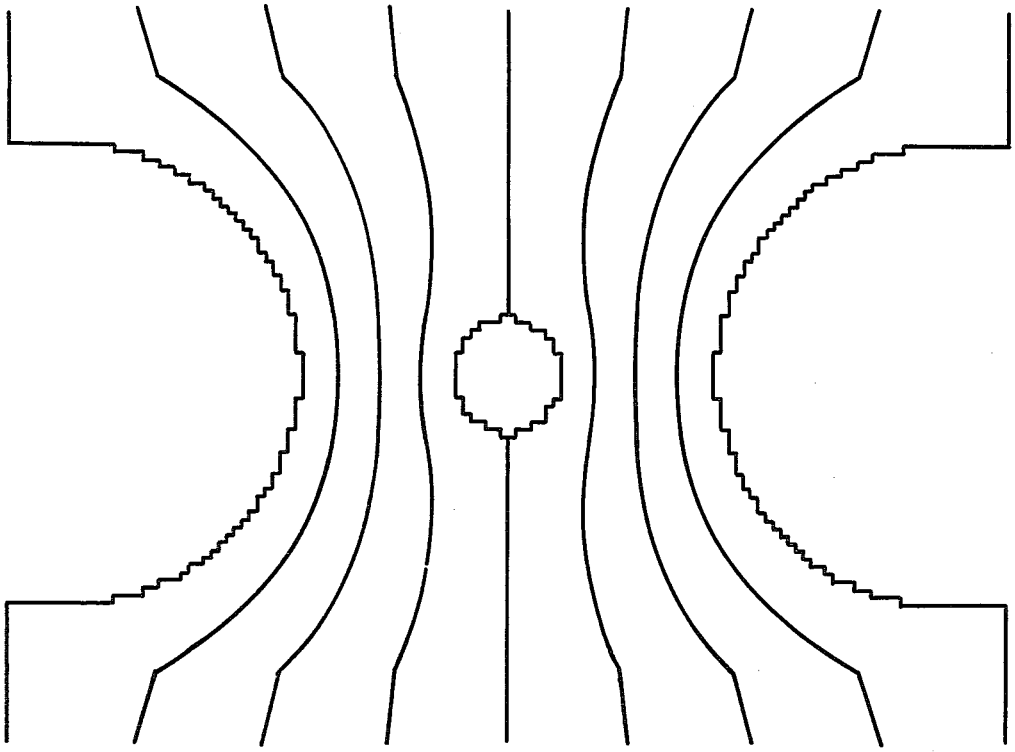
PRIOR ART FIG. 3A
FIG. 3(*a*) is an electrical potential analysis of a conventional triggered spark gap with a round, or cylindrical, trigger electrode prior to switching.
Figure 3B:
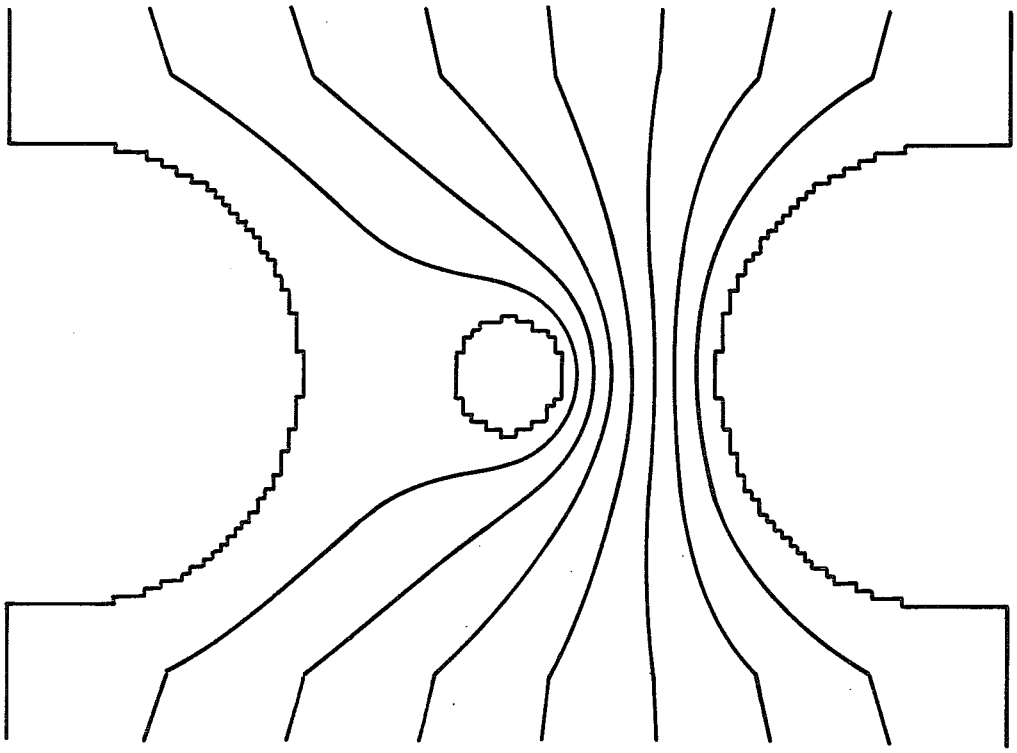
PRIOR ART FIG. 3B

FIGS. 3(*a*) and 3(*b*) show the switching action of a trigger electrode of substantially circular crossection. In this case the electric field is distorted at the trigger electrode. The effect is not large and can be removed by a small amount of erosion of the trigger electrode face closest to the main electrode. Greater electric field enhancement can be achieved with the use of small diameter trigger electrodes, however, these are more easily eroded through and have poor thermal characteristics for high average power switches.

Figure 4A:
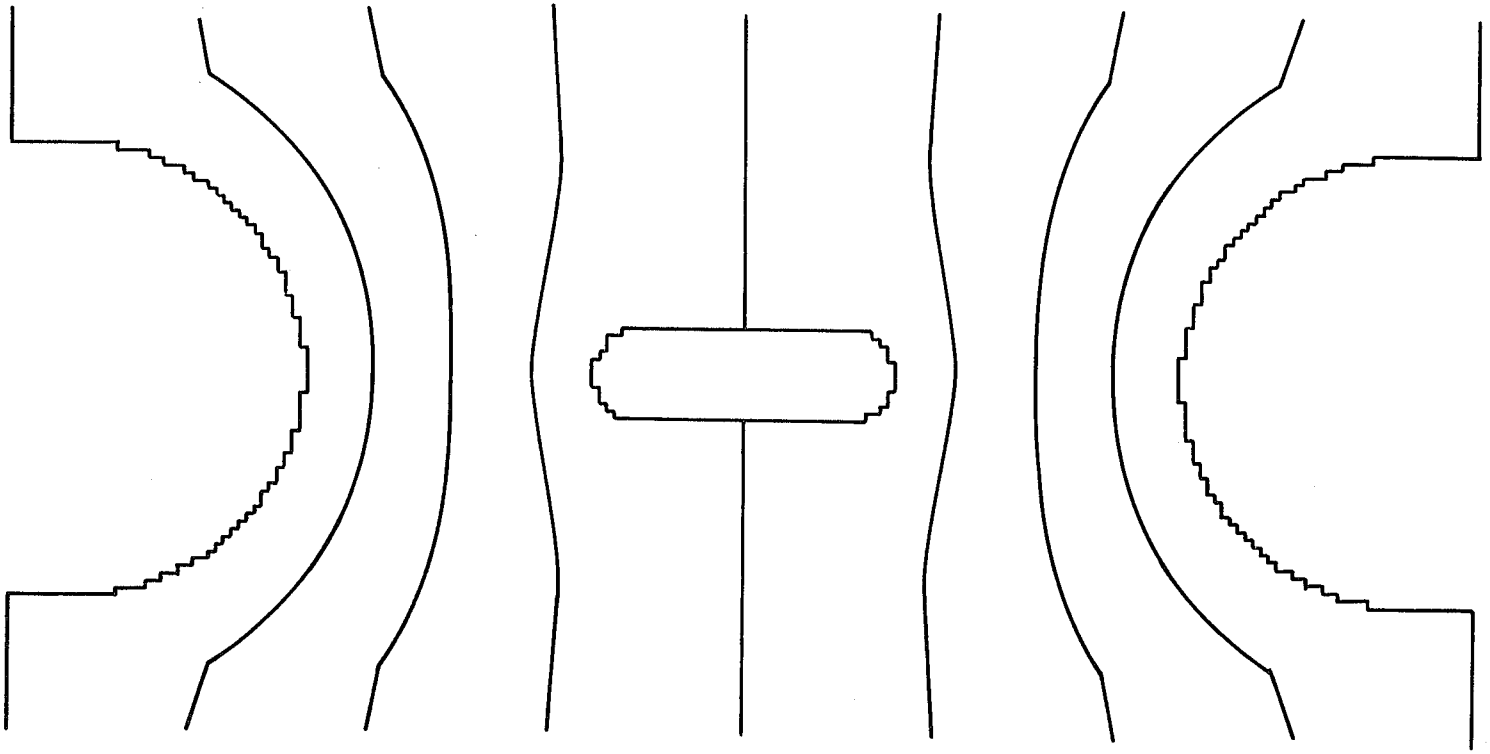
FIG. 4(*a*) is an electric potential analysis of a triggered spark gap in accordance with the present invention prior to switching.
Figure 4B:
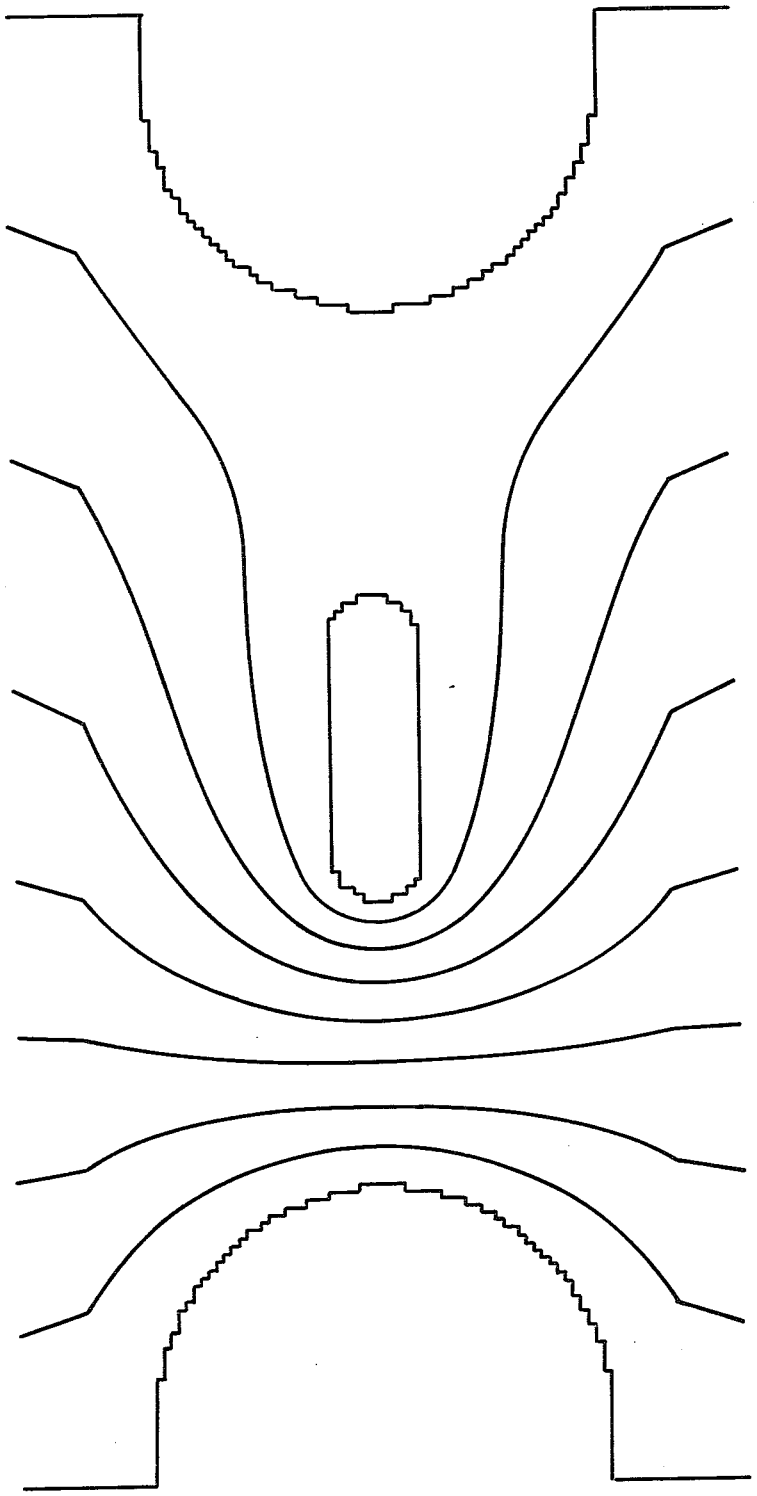

FIGS. 4(*a*) and 4(*b*) show the principles of the present invention. The trigger electrode is elongated in the direction of current flow and large electric field distortions occur over its face. The electric field distortion is primarily due to the ratio of the thickness to the width of the trigger electrode, shown as dimensions t and w in FIG. 1. Erosion of the trigger electrode does not affect switching range until the thickness, dimension t, has been substantially reduced, thus switching performance remains satisfactory until gross erosion has occurred.

Cooling of the switch electrodes at high average powers is, of course, a design consideration. Referring to FIG. 1, the main electrodes 21 and 22 can be firmly bonded to the flanges 4 and 5 and need present no problems. The trigger electrode 7, has a much less adequate heat conduction path to a source of cooling. The increase in the thickness, dimension t, of electrode 7 increases the crossectional area through which heat passes and greatly aids in reducing the temperature of the trigger electrode.

Figure 5:
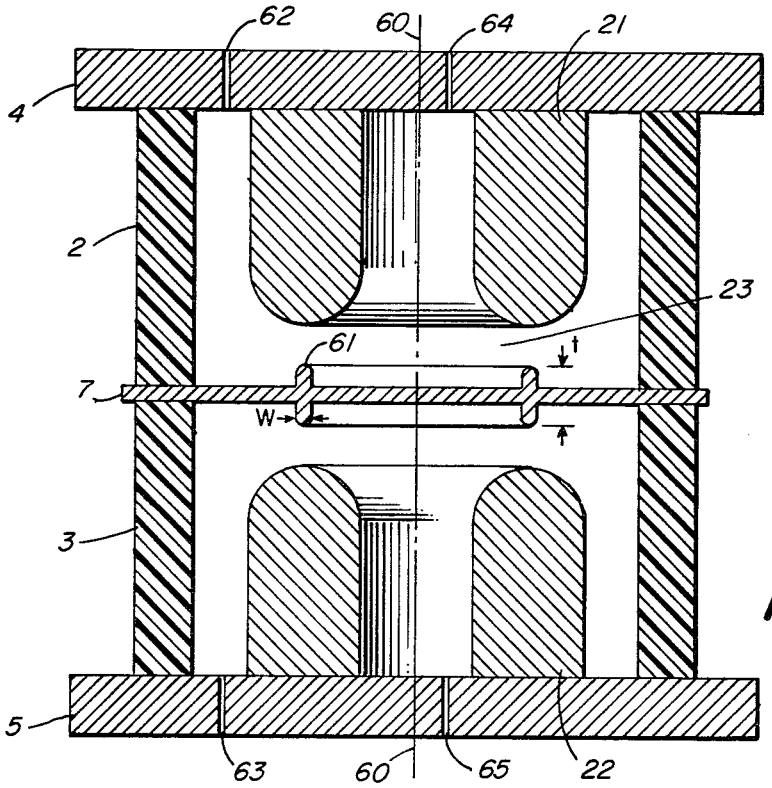
FIG. 5 shows a cross-sectional view of a first alternative embodiment of the present invention.

A modification of the present invention is shown in FIG. 5. The device has circular symmetry about the axis 60—60. This switch has a large area available for arcing and a gas flow via gas inlets 62 and 63 and gas outlets 64 and 65 is suited to remove the electrode debris from the switch housing. This embodiment is suitable for the very highest powers, both peak and average. The tubular protruberance 61 on the trigger electrode in the gap 23 between the main electrodes 21 and 22 governs the switch performance, the electric field distortion being governed by the ratio of the thickness to the width of the protruberance shown as dimensions t and w respectively in FIG. 5. If dimension t shown in FIG. 5 is greater than dimension w then the switching range is relatively insensitive to electrode erosion as has been discussed regarding the embodiment above.

Figure 6:
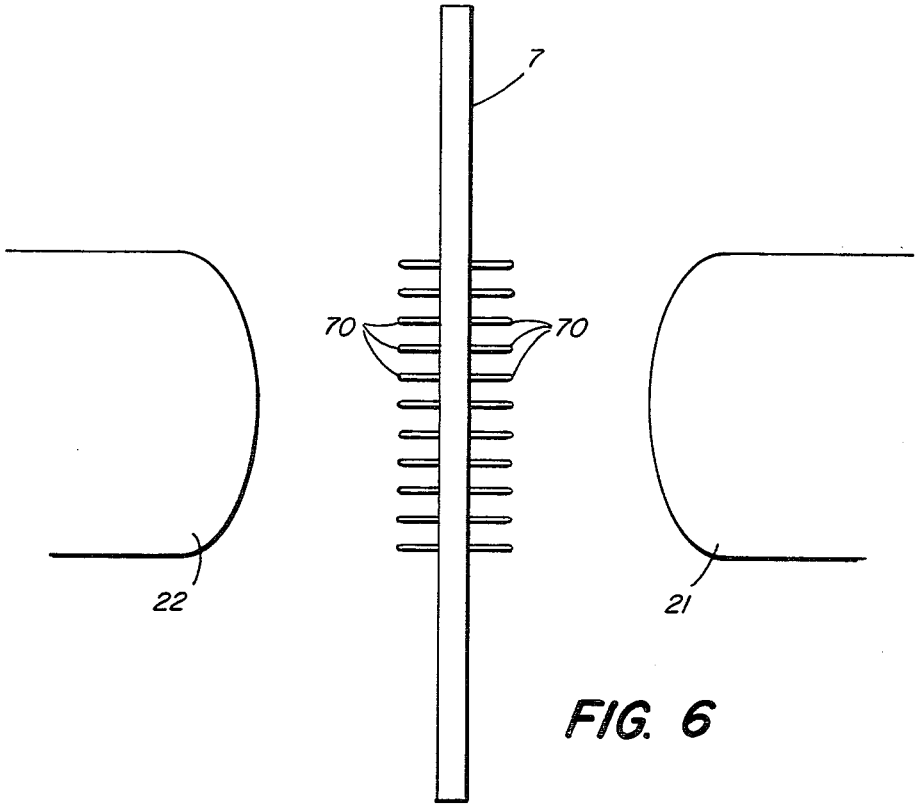
FIG. 6 diagramatically shows a first alternative electrode configuration suitable for use with the present invention.

In another form of the invention the trigger electrode has a series of spikes or needles 70 facing the main electrodes as shown in FIG. 6. The switching range of this switch depends on the length and diameter of these needles, the largest switching range occurring when the length of each needle is greater than its diameter.

Figure 7:
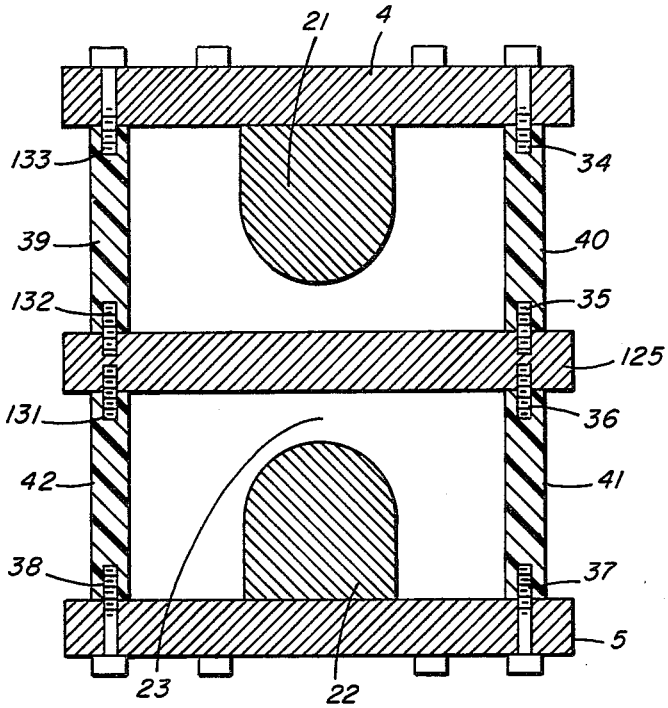
FIG. 7 is a cross-sectional view of a second alternative embodiment of the present invention.

Yet another modification of the present invention is shown in FIG. 7. In this embodiment a frame consisting of insulating rods 39, 40, 41 and 42 separates metallic flanges 4 and 5 from the trigger electrode 25 which again has a thickness to width ratio greater than one. The rods 39, 40, 41, and 42 are shown secured to the flanges 4 and 5 and to the trigger electrode 125 by means of screws 131, 132, 133, 34, 35, 36, 37, and 38 but alternatively, the securing may be done by brazing or gluing each joint. Fixed or main electrodes 21 and 22 are secured opposite to each other within the frame to flanges 4 and 5 respectively thereby forming gap 23 therebetween through which trigger electrode 125 passes.

Figure 8A:
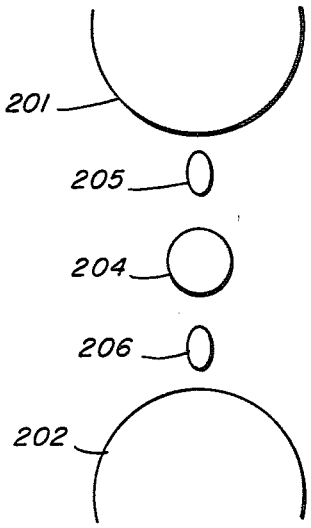
FIG. 8(*a*) diagramatically shows a second alternative electrode configuration suitable for use with the present invention including two main electrodes, a mid-electrode, and two trigger electrodes.
Figure 8B:
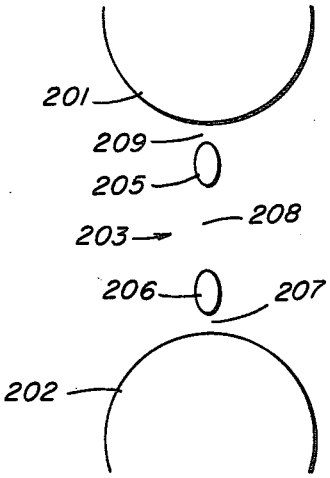

It will also be understood that the benefits and advantages of the present invention are not limited to three electrode spark gaps. Devices commonly known as cascade gaps have been developed wherein a plurality of electrodes are disposed at intervals across the gap between the main electrodes in order to obtain an expanded switching range. Two examples of a cascade gap utilizing the principles of the present invention are shown in FIGS. 8(*a*) and 8(*b*) diagramatically. Specifically, in FIG. 8(*a*) main electrodes 201 and 202 are so disposed as to form a gap therebetween. An electrode 204, which may be a disc (with or without a center hole), a sphere, or a cylinder is disposed in gap 203 midway between main electrodes 201 and 202. Trigger electrodes 205 and 206 are substantially identical, have a cross-sectional thickness to width ratio greater than one, and are appropriately disposed in gap 203 such that electrode 205 is substantially midway between electrodes 204 and 201 and electrode 206 is substantially midway between electrodes 204 and 202. Given this configuration, it will be readily seen by analogy to the three electrode case described above that prior to switching electrodes 204, 205, and 206 are held at the same potential as the equipotential which corresponds to their respective physical location within the gap 203. Switching is then initiated by applying substantially identical voltage pulses to electrodes 205 and 206, thereby causing switching action in the gaps between electrodes 201 and 205 and between electrodes 206 and 204 corresponding to the three electrode case described above. Switching action between electrodes 204 and 205, and between electrodes 206 and 202 then follows. In FIG. 8(*b*), on the other hand, electrode 204 is not present and electrodes 205 and 206 may be substantially evenly spaced across the gap 203 and are held at equilibrium potentials prior to switching. Switching is then initiated by applying a voltage pulse to electrode 205 or to electrode 204, depending upon the polarities of main electrodes 201 and 202 and of the voltage pulse, and arcs cross the gaps 207, 208, and 209 sequentially to complete the switching action.

It should further be understood that the embodiments and practices described and portrayed herein have been presented by way of disclosure, rather than limitation, and that various substitutions, modifications, and combinations may be effected without departure from the spirit and scope of this invention in its broader aspects. For example, a triggered spark gap in accordance with this invention need not have the main electrodes 21 and 22 as shown in FIG. 1. In such a case the flanges 4 and 5 would act as electrodes; and on receipt of an electrical pulse, one or more protuberances on the trigger electrode would initiate switching action, the thickness to width ratio of these protuberances determining switch performance. Similarly, the trigger electrode need not have cylindrical portion 6. In such a case a single insulator would extend between flanges 4 and 5 and straight portion 24 of trigger electrode 7 would simply extend through openings on opposite sides of such an insulator.

What is claimed is:

1. A triggered spark gap comprising support means, a pair of insulated main electrodes mounted opposite each other on said support means so as to form a gap therebetween; first electrical means operatively associated with said main electrodes for creating a potential difference therebetween; at least one trigger electrode having at least a portion thereof located in the gap between said main electrodes, said portion defining an arc receiving region having a thickness to width ratio greater than one; and second electrical means for connecting the trigger electrode to a source of triggering and biasing electrical potential.

2. The triggered spark gap of claim 1 wherein said support means is a housing.

3. The triggered spark gap of claim 2 wherein said housing includes means for controlling the pressure and composition of the environment within the housing.

4. The triggered spark gap of claim 1 or claim 2 or claim 3 wherein the arc receiving region comprises a plurality of protuberances extending from the trigger electrode parallel to the direction of current flow, and wherein each of said protuberances has a thickness to width ratio greater than one.

5. The triggered spark gap of claim 2 further including means for removing eroded electrode debris from the housing during operation.

* * * * *